US006832695B2

(12) United States Patent
Yamaguchi

(10) Patent No.: US 6,832,695 B2
(45) Date of Patent: Dec. 21, 2004

(54) VENDING MACHINE WITH A VIBRATION SENSOR FOR CARRYING OUT GOODS

(75) Inventor: Tomomi Yamaguchi, Isesaki (JP)

(73) Assignee: Sanden Corporation, Gunma (JP)

( * ) Notice: Subject to any disclaimer, the term of this patent is extended or adjusted under 35 U.S.C. 154(b) by 84 days.

(21) Appl. No.: 10/393,016

(22) Filed: Mar. 21, 2003

(65) Prior Publication Data

US 2003/0178435 A1 Sep. 25, 2003

(30) Foreign Application Priority Data

Mar. 22, 2002 (JP) ..... 2002-081334

(51) Int. Cl.[7] ..... B65H 3/00
(52) U.S. Cl. ..... 221/195; 221/200
(58) Field of Search ..... 221/200, 202, 221/203, 196, 134, 278, 171, 92, 194.195

(56) References Cited

U.S. PATENT DOCUMENTS 5,269,440 A * 12/1993 Bohnert et al. ..... 221/200
5,833,205 A * 11/1998 Lindbeck ..... 248/671

FOREIGN PATENT DOCUMENTS

JP 06-348935 12/1994

* cited by examiner

*Primary Examiner*—Kenneth Noland
(74) *Attorney, Agent, or Firm*—BAnner & Witcoff, Ltd.

(57) ABSTRACT

A vending machine drives a vibrating device when a goods selection signal is inputted. A vibration is generated in a receiving plate by the driving of the vibrating device. When a vibration sensor detects the vibration of the receiving plate, a microcomputer judges that the vibration sensor is normal. On the other hand, when the vibration sensor does not detect the vibration, the microcomputer judges that the vibration sensor is abnormal. When it is judged that the vibration sensor is normal, driving of a goods carrying-out device is started. On the other hand, when it is judged that the vibration sensor is abnormal, the driving of the goods carrying-out device is prohibited.

8 Claims, 5 Drawing Sheets

VENDING MACHINE WITH A VIBRATION SENSOR FOR CARRYING OUT GOODS

BACKGROUND OF THE INVENTION

1. Field of the Invention

The present invention relates to a vending machine which picks up a vibration of a receiving plate to detect whether or not goods have been carried out.

2. Description of the Related Art

Conventionally, as a vending machine of this type, there has been known one described in Japanese Patent Application Laid-Open No. 6-348935.

In this vending machine, when a customer inserts a coin and presses a goods selection switch, a goods carrying-out device of a column corresponding to selected goods is driven and the selected goods fall on a receiving plate of a goods taking-out port. When the goods fall, the goods collide with the receiving plate and a vibration is generated in the receiving plate. A vibration sensor detects the vibration of the receiving plate, and a judging device judges that the goods have been carried out according to a vibration detection signal. On the other hand, when the vibration sensor does not detect a vibration of the receiving plate, the judging device judges that goods have not been carried out to the goods taking-out port and returns the inserted coin to the customer. Consequently, an inconvenience that the inserted coin is taken into the vending machine without being exchanged with goods is prevented from occurring.

In addition, among other types of vending machines, there is one which stops driving of a goods carrying-out device and shifts to a sales standby state of a next goods to be sold when a vibration sensor detects a falling vibration.

Incidentally, the vibration sensor is installed in a part where a vibration can be detected accurately, that is, a part of the receiving plate which is subjected to a largest vibration impact. Consequently, it is likely that a sensing section of the vibration sensor is broken or a joint section of a lead wire is broken. In addition, it is also likely that water drops adhere to adjacent lead wires due to dew concentration in the vending machine to cause short circuit.

There is no problem if such a deficiency is found immediately when it occurs and a measure is taken to cope with a failure of the vibration sensor. However, actually, it is likely that long time elapses until the failure is recognized, that is, until the judging device judges that a vibration which is naturally generated has not been generated. Due to this problem, in the former vending machine, it is likely that a situation in which an inserted coin is taken into the vending machine by mistake frequently occurs. In addition, in the latter vending machine, it is likely that the goods carrying-out device continues to be driven even after goods have already been carried out, and following goods are also carried out by mistake.

SUMMARY OF THE INVENTION

In view of the above-described conventional problems, it is an object of the present invention to provide a vending machine which can find a failure of a vibration detecting device promptly and accurately.

A vending machine in accordance with a first aspect of the present invention includes: a goods carrying-out device which is driven so as to carry out goods when a goods selection signal of a goods selection switch is inputted; a receiving plate which receives the goods carried out from the goods carrying-out device; a vibration detecting device which is capable of detecting a vibration generated in the receiving plate; a vibrating device which strikes the receiving plate to cause the receiving plate to generate a vibration in the receiving plate; and a judging device which judges whether the vibration detecting device is normal or abnormal according to whether or not the vibration detecting device has detected the vibration generated by the strike of the vibrating device.

According to the first aspect of the present invention, the receiving plate is vibrated by driving the vibrating device. Here, it is judged that the vibration detecting device is normal when it detects the vibration. On the other hand, it is judged that the vibration detecting device is abnormal when it does not detect the vibration.

The above-described object and other objects of the present invention, and characteristics and advantages thereof will be apparent from the following description and accompanying drawings.

DESCRIPTION OF THE PREFERRED EMBODIMENTS

FIGS. 1 to 6 show an embodiment of a vending machine in accordance with the present invention.

Figure 1:
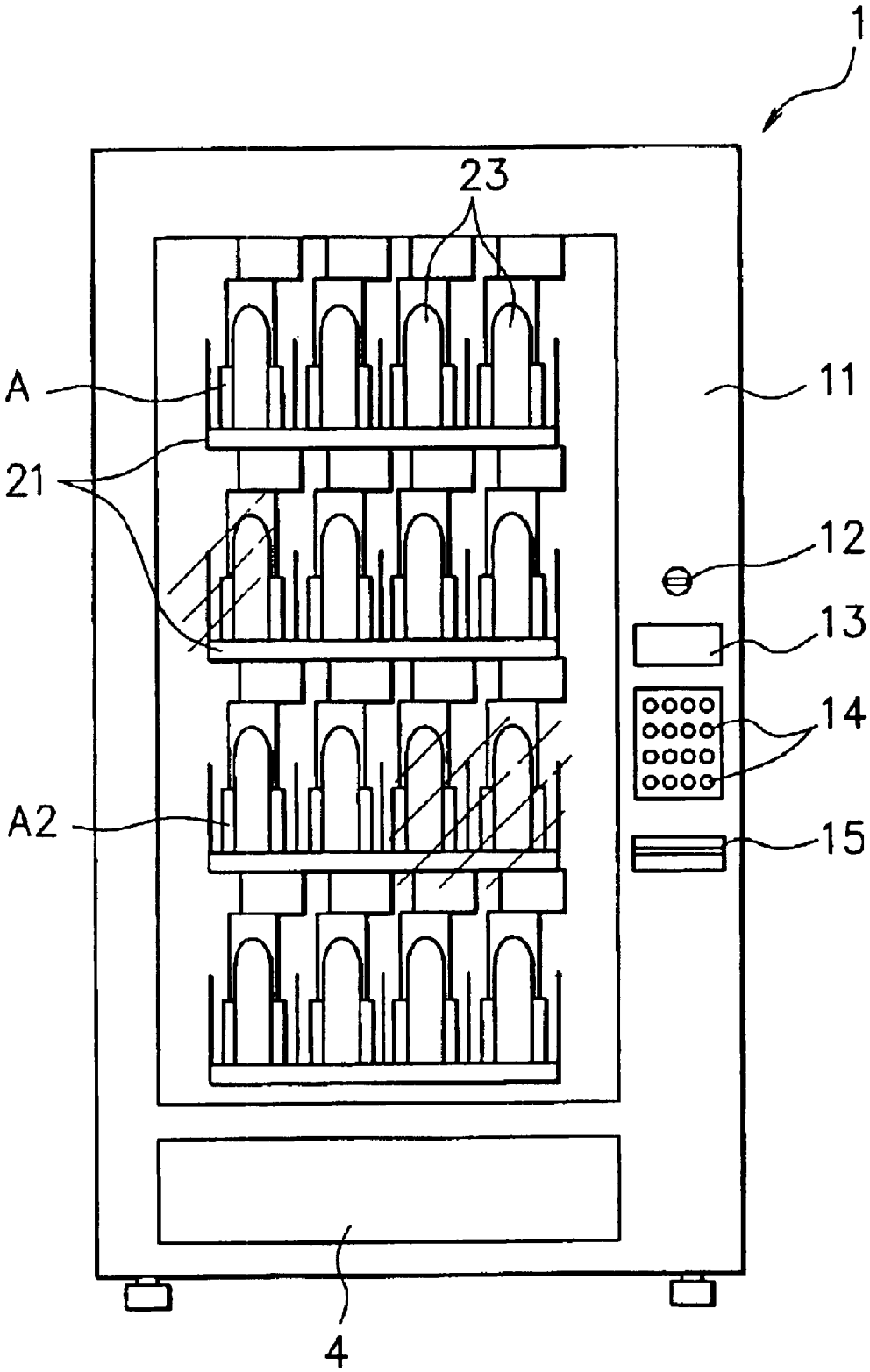
FIG. 1 is a front view of a vending machine.

A schematic structure of this vending machine will be described with reference to FIGS. 1 and 2. This vending machine 1 is provided with a coin inserting port 12, a display device 13 on which characters or the like are displayed with LED, a large number of goods selection switches 14 to be selected by a customer, a bill inserting port 15, and the like on a front door 11 thereof. In addition, inside the vending machine 1, goods carrying-out devices 2 extended depthwise are arranged in four rows widthwise and four stages lengthwise. Goods A are placed on a goods shelf 21 of the respective goods carrying-out devices 2 in one row depthwise. A pushing-out mechanism 22 for pushing out the goods A forward is provided above the respective goods shelves 21. A stopper mechanism 23 for stopping forward movement of the goods A2 in the frontmost part is provided at a front end of the respective goods shelves 21.

Figure 2:
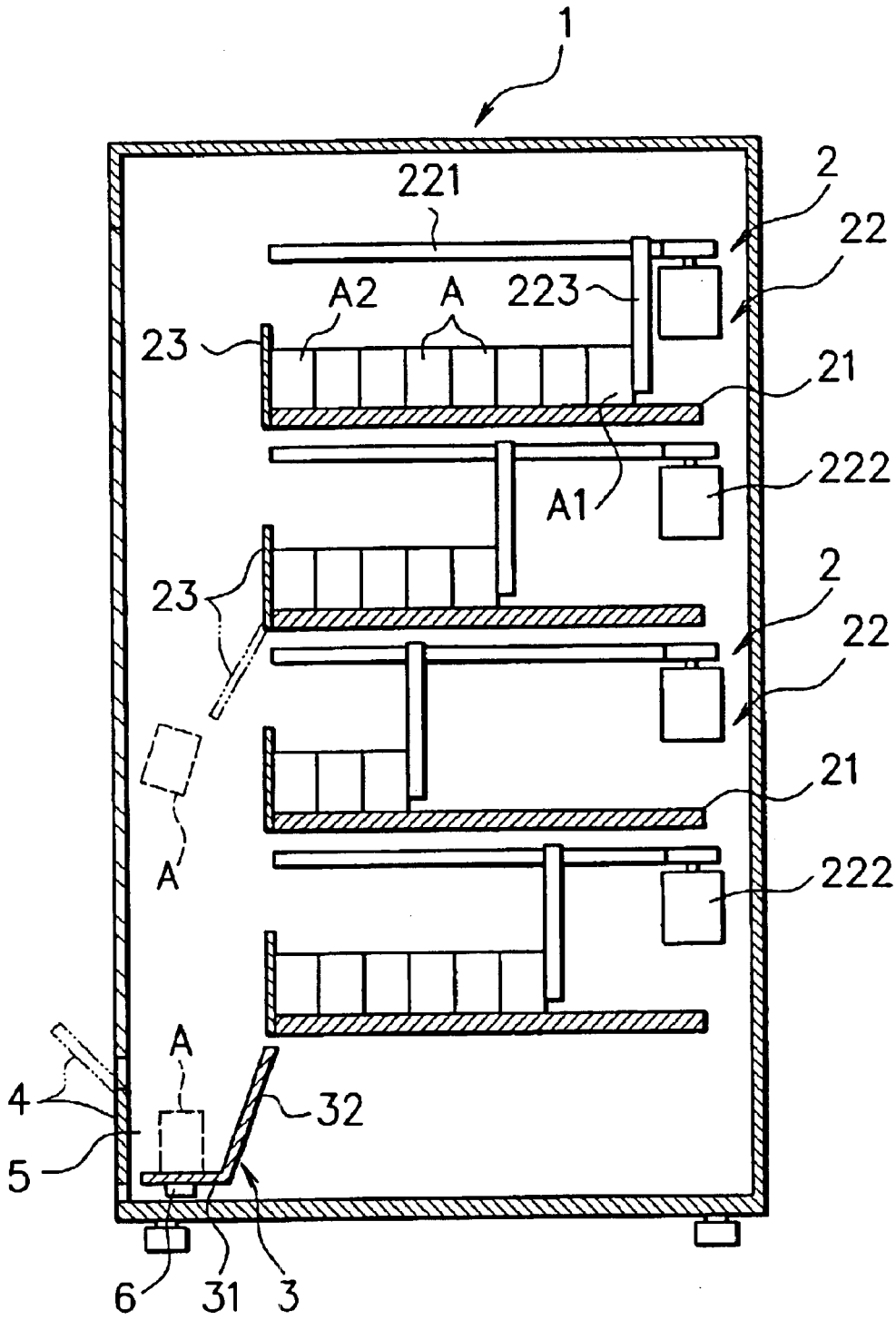
FIG. 2 is a schematic side view showing an internal structure of the vending machine.

As shown in FIG. 2, the pushing-out mechanism 22 includes a timing belt 221 which is arranged above the goods shelf 21 and extended over the entire depthwise direction of the goods shelf 21, a motor 222 for pivoting the timing belt 221, and carrying-out piece 223 adhered to the timing belt 221. When the motor 222 is driven, the carrying-out piece 223 presses goods A1 in the rearmost part forward from its back so as to push out the entire goods A on the goods shelf 21 forward.

As indicated by an alternate long and two short dash lines of FIG. 2, goods A2 in the frontmost part of the goods shelf 21 push down the stopper mechanism 23. Consequently, the goods A2 in the frontmost part fall from the goods shelf 21 and are received by the receiving plate 3. Then, a customer opens a door 4 in front of the receiving plate 3. In this way, goods A selected by the customer is taken out from a goods taking-out port 5 and sold to the customer.

Figure 3:
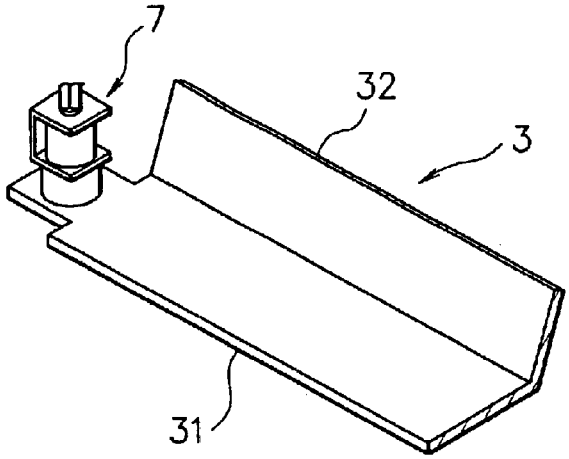
FIG. 3 is a perspective view showing a receiving plate and a vibrating device.

As shown in FIG. 3, the receiving plate 3 includes a bottom plate 31 and an inclined plate 32 extending obliquely rearward from a rear end of the bottom plate 31. A vibration detecting device, for example, a vibration sensor 6 using a well-known piezoelectric element is provided on a back of this bottom plate 31 so as to detect a vibration generated when the goods A fall on the receiving plate 3.

Figure 4:
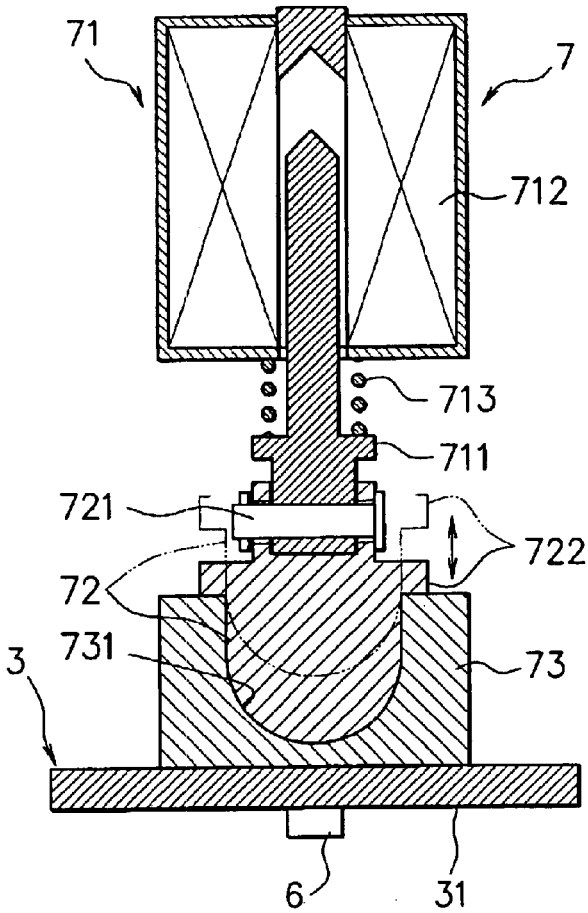
FIG. 4 is a sectional view showing a structure of the vibrating device.

A vibrating device 7 is provided at one end in a longitudinal direction of the bottom plate 31 of the receiving plate 3. As shown in FIG. 4, this vibrating device 7 is constituted by a solenoid 71, a striking section 72, and a vibrating section 73.

The solenoid 71 includes a plunger 711 which is movable vertically. A wound coil 712 is arranged around this plunger 711. When this coil 71 is energized, the plunger 711 is attracted upward. In addition, when the energization of the coil 712 ends, the plunger 711 is biased downward by a return spring 713.

The striking section 72 is coupled to a lower end of the plunger 711 by a coupling pin 721 so as to move vertically in association with the vertical movement of the plunger 711. In addition, the striking section 72 is formed of a hard metal material and in a substantially semispherical shape, and has a flange section 722 at an upper end peripheral edge thereof.

The vibrating section 73 is formed of a hard metal material, and a bottom surface thereof is adhered to an upper surface of the receiving plate 3. In addition, an upper surface of the vibrating section 73 is bored so as to match a shape of the striking section 72. When the striking section 72 is biased downward, the striking section 72 collides against the bored part 731.

Figure 5:
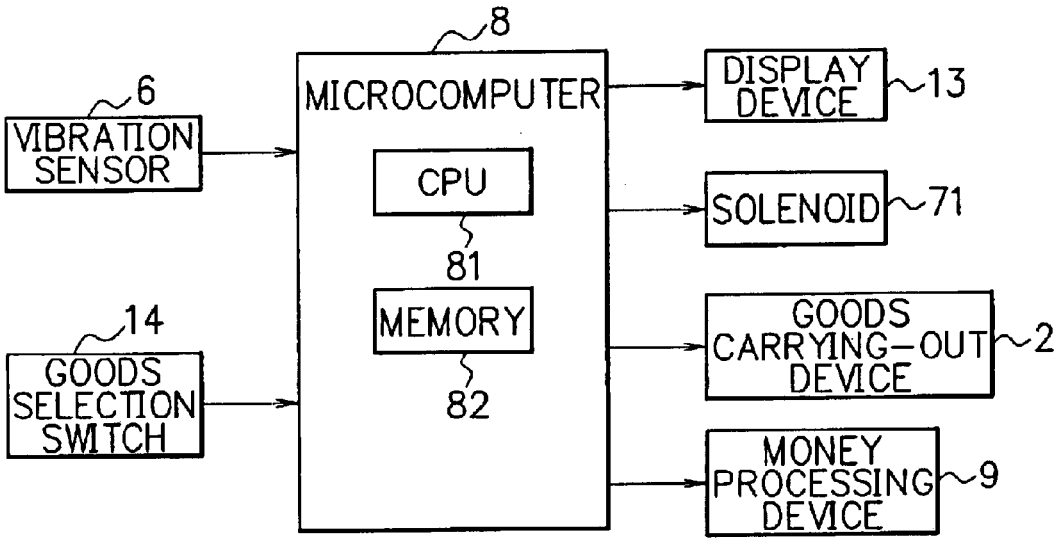
FIG. 5 is a block diagram showing a drive control circuit of the vending machine.

Next, a drive control circuit of the vending machine in accordance with this embodiment will be described with reference to a block diagram of FIG. 5 and a flowchart of FIG. 6.

The vending machine 1 is controlled by a microcomputer 8. The vending machine 1 performs control of respective devices and judgment of appropriateness (abnormal or normal) of the vibration sensor 6 with a CPU 81 of the microcomputer 8. In addition, the vending machine 1 stores various kinds of information with a memory 82. Further, a detection signal from the vibration sensor 6 and a goods selection signal from the goods selection switches 14 are inputted in the microcomputer 8. The microcomputer 8 controls the display device 13, the solenoid 71, the goods carrying-out device 2, a money processing device 9 based upon these signals. Here, the money processing device 9 is defined as a device for performing truth or false judgment, denomination judgment, change processing, coin/bill return processing of a coin inserted from the coin inserting port 12 and a bill inserted from the bill inserting port 15.

Figure 6:
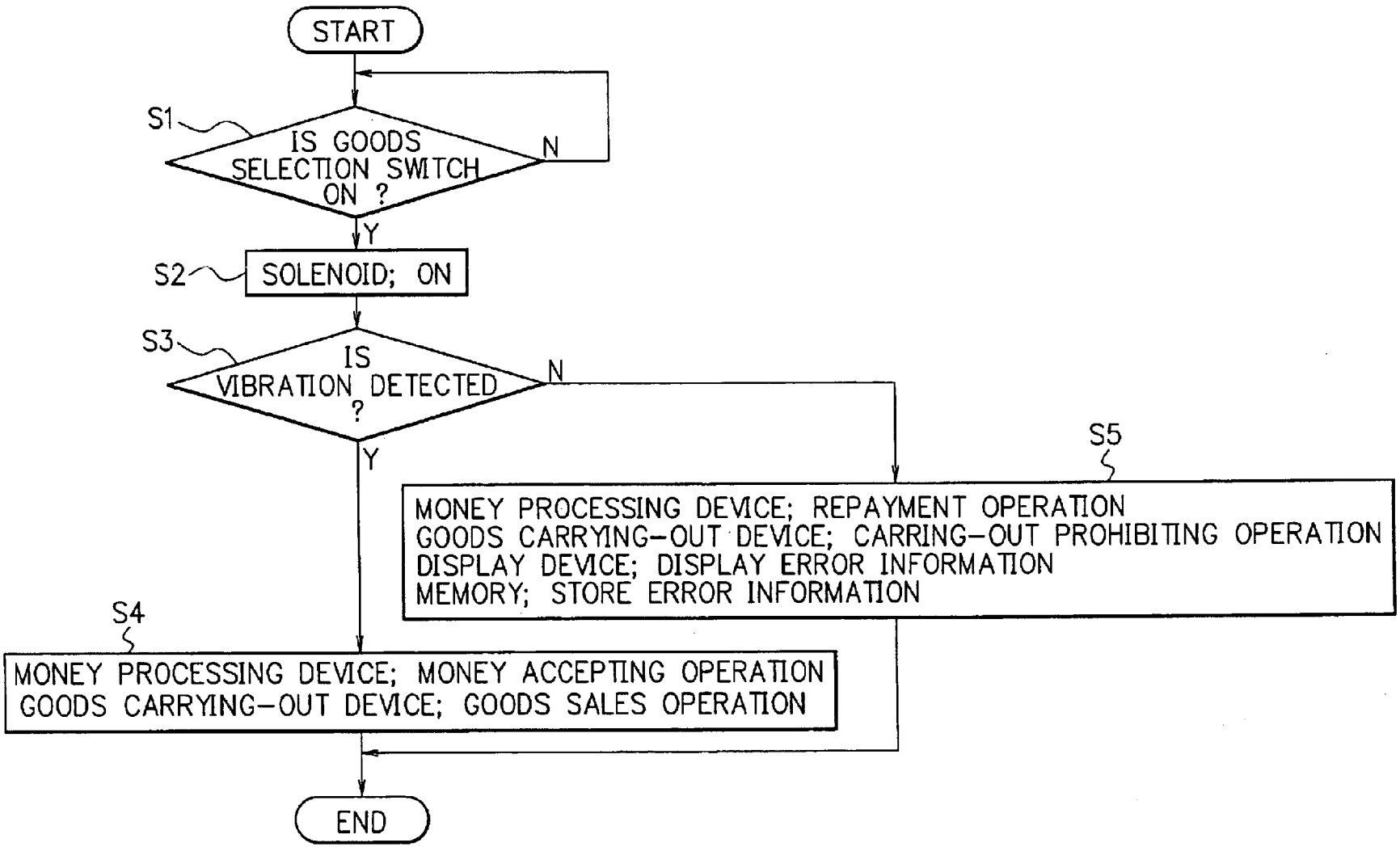
FIG. 6 is a control flowchart of the vending machine.

As shown in FIG. 6, the respective devices 2, 9, 13, and 71 are controlled by the microcomputer 8. That is, after a coin or a bill is inserted, the microcomputer 8 watches whether or not a goods selection signal is inputted from the goods selection switch 14 (S1). When the goods selection signal is inputted, the coil 712 of the solenoid 71 is energized over a short time (S2). Consequently, the plunger 711 is attracted upward and, at the same time, the striking section 72 is also attracted upward as indicated by an alternate long and two short dash lines of FIG. 4. Then, after the energization of the coil 712 ends, the plunger 711 is biased downward by the return spring 713. The striking section 72 collides with the vibrating section 73 by the downward biasing of the plunger 711, and the vibrating section 73 vibrates. This vibration is propagated to the bottom plate 31 of the receiving plate 3, and the bottom plate 31 also vibrates.

At this point, the microcomputer 8 watches whether or not the vibration sensor 6 has detected a vibration of the bottom plate 31 (S3). When the vibration sensor 6 detects the vibration of the bottom plate 31, the microcomputer 8 judges that the vibration sensor 6 is normal. Then, the respective devices 2 and 9 perform a normal goods carrying-out operation and a money accepting operation. That is, the microcomputer 8 drives the good carrying-out device 2 to drop selected goods toward the receiving plate 3. Then, after the vibration sensor 6 picks up a vibration due to the fall of goods, the microcomputer 8 drives the money processing device 9 to perform a money accepting operation of the inserted coin or the inserted bill (S4).

On the other hand, when the vibration sensor 6 has not detected the vibration of the receiving plate 3 in step S3, the microcomputer 8 judges that the vibration sensor 6 is abnormal. When the vibration sensor 6 is judged abnormal, the respective devices 2 and 9 perform a return operation of the inserted coin or the inserted bill and, at the same time, inputs a drive prohibit signal (signal prohibiting rotation of the motor 222) to the respective goods carrying-out devices 2. In addition, the microcomputer 8 controls the display device 13 to display an abnormal message in order to inform the customer of the abnormality of the vibration sensor 6. In addition, the microcomputer 8 stores information on abnormality in the memory 82 such that a serviceman (person going around to watch states of vending machines) can retrieve the message from the microcomputer 8 (S5).

As described above, the vending machine in accordance with this embodiment can judge whether the vibration sensor 6 is normal or abnormal by appropriately driving the vibrating device 7.

In addition, when the vibration sensor 6 is abnormal, driving of the goods carrying-out device 2 is prohibited, and the inserted coin or the inserted bill is returned. Therefore, an inconvenience that the inserted coin is taken into the vending machine without being exchanged with goods does not occur. In addition, a plurality of goods A are not continuously carried out by mistake.

Moreover, when it is judged that the vibration sensor 6 is abnormal, since the microcomputer 8 controls the display device 13 to display the abnormal message, the customer can be informed of the abnormality. In addition, since the serviceman can obtain the information on abnormality of the vibration sensor 6, various maintenances including replacement of the vibration sensor 6 can be performed promptly.

Furthermore, a method of sending various kinds of information of vending machines placed various parts of the country to a central computer of a vending machine management center to centrally manage the information has been put to practical use. Therefore, in the case in which a transmission device is provided in the vending machine 1 in accordance with this embodiment, information on abnormality stored in the memory 82 is sent to the central computer immediately, and the vending machine can be restored promptly.

Note that, although the example in which only one vibration sensor 6 is provided on the bottom plate 31 is explained as an example in the above-mentioned embodiment, a plurality of vibration sensors 6 may be provided, although not illustrated. In this case, even if one of vibration sensors 6 becomes abnormal, other vibration sensors 6 can assist the vibration sensor 6. Therefore, even if time is required more or less until the abnormal vibration sensor is replaced, the other vibration sensors 6 assist the vibration sensor, whereby goods sales can be continued and chances of selling goods are not lost.

In addition, in the above-described embodiment, the vibrating device 7 is driven after the goods selection switch 14 is pressed and before the goods carrying-out device 2 is driven. However, the driving of the vibrating device 7 may be performed at timing other than this, for example, a predetermined time interval.

What is claimed is:

1. A vending machine comprising:

a goods carrying-out device which is driven so as to carry out goods when a goods selection signal is inputted from a goods selection switch;

a receiving plate which receives the goods carried out from said goods carrying-out device;

a vibration detecting means which is capable of detecting a vibration generated in said receiving plate;

a vibrating device which strikes said receiving plate to cause said receiving plate to generate a vibration; and a judging means which judges whether said vibration detecting means is normal or abnormal according to whether or not said vibration detecting means has detected the vibration generated by the strike of said vibrating device.

2. The vending machine according to claim 1, further comprising control means which controls said vibrating device such that a striking operation of said vibrating device is performed after a goods selecting operation of said goods selection switch and before a goods carrying-out operation of the goods carrying-out device is started.

3. The vending machine according to claim 2, wherein, when it is judged by said judging means that said vibration detecting means is abnormal, said control means controls said goods carrying-out device such that driving of said goods carrying-out device is prohibited.

4. The vending machine according to claim 1, further comprising a display means which displays information on abnormality of said vibration detecting means.

5. The vending machine according to claim 2, further comprising a display means which displays information on abnormality of said vibration detecting means.

6. The vending machine according to claim 3, further comprising a display means which displays information on abnormality of said vibration detecting means.

7. The vending machine according to claim 6, further comprising a transmission means for transmitting the information on abnormality of said vibration detecting means to a computer in which information on vending machines is collected and managed.

8. The vending machine according to claim 7, wherein said vibration detecting means are provided in a plural form.

* * * * *